US009834928B2

(12) United States Patent
Baxter et al.

(10) Patent No.: US 9,834,928 B2
(45) Date of Patent: Dec. 5, 2017

(54) LINEAR SURFACE COVERING SYSTEM

(71) Applicant: ARMSTRONG WORLD INDUSTRIES, INC., Lancaster, PA (US)

(72) Inventors: Nathan J. Baxter, Lancaster, PA (US); Eric Krantz-Lilienthal, Janesville, WI (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 14/513,536

(22) Filed: Oct. 14, 2014

(65) Prior Publication Data

US 2015/0040506 A1 Feb. 12, 2015

Related U.S. Application Data

(63) Continuation of application No. 12/660,583, filed on Mar. 1, 2010, now Pat. No. 8,857,121.

(Continued)

(51) Int. Cl.

| | |
|---|---|
| ***E04B 9/26*** | (2006.01) |
| ***E04B 9/04*** | (2006.01) |
| ***E04B 9/36*** | (2006.01) |

(52) U.S. Cl.

CPC ..... *E04B 9/26* (2013.01); *E04B 9/0464* (2013.01); *E04B 9/363* (2013.01)

(58) Field of Classification Search

CPC . E04B 9/04; E04B 9/0464; E04B 9/06; E04B 9/10; E04B 9/18; E04B 9/183; E04B 9/205; E04B 9/22; E04B 9/225; E04B 9/24; E04B 9/242; E04B 9/245; E04B 9/26; E04B 9/28; E04B 9/36; E04B 9/363; E04F 13/07; E04F 13/072; E04F 13/08; E04F 13/0801; E04F 13/0805; E04F 13/081; E04F 13/0812; E04F 13/0814;

(Continued)

(56) References Cited

U.S. PATENT DOCUMENTS

| | | | |
|---|---|---|---|
| 325,009 | A | 8/1885 | Peterson |
| 1,728,231 | A | 9/1929 | Denk |

(Continued)

FOREIGN PATENT DOCUMENTS

| | | | |
|---|---|---|---|
| CN | 87205621 | U | 1/1988 |
| CN | 200985577 | Y | 12/2007 |

(Continued)

OTHER PUBLICATIONS

European Search Report, dated May 15, 2014, for corresponding EP Application No. 10746573.4, filed Sep. 27, 2011. EP.

(Continued)

*Primary Examiner* — Jessica Laux
(74) *Attorney, Agent, or Firm* — Craig M Sterner

(57) ABSTRACT

The invention relates to a surface covering system, and, more specifically, to an improved linear surface covering system. The improvement includes each plank of the system having multi-directionally cut grooves. The improvement further includes clip projections which conform substantially to a notch formed by the multi-directional grooves. The system also includes an improved splice plate for stabilizing two adjacent planks positioned in end-to-end relation.

20 Claims, 5 Drawing Sheets

Related U.S. Application Data

(60) Provisional application No. 61/156,036, filed on Feb. 27, 2009.

(58) Field of Classification Search
CPC . E04F 13/0816; E04F 13/083; E04F 13/0819; E04F 13/0821; E04F 13/0835; E04F 13/0841; E04F 13/0851; E04F 13/0858; E04F 13/086; E04F 13/0862
See application file for complete search history.

(56) References Cited

U.S. PATENT DOCUMENTS

| | | | | |
|---|---|---|---|---|
| 2,005,030 | A | 6/1935 | Geisinger | |
| 2,653,686 | A | 9/1953 | Routt | |
| 3,175,656 | A | 3/1965 | Schoenfeld | |
| 3,745,734 | A | 7/1973 | Davey | |
| 4,033,083 | A | 7/1977 | Fritz | |
| 4,395,858 | A | 8/1983 | Gwyther | |
| 4,546,587 | A | 10/1985 | Mosch | |
| 4,635,424 | A | 1/1987 | Drapeau | |
| 5,822,941 | A | 10/1998 | Kinsella | |
| 6,446,405 | B1 | 9/2002 | Pervan | |
| 6,922,964 | B2 * | 8/2005 | Pervan | E04F 15/02 52/480 |
| 7,010,894 | B1 * | 3/2006 | Cappelle | E04B 9/26 52/384 |
| 7,121,059 | B2 | 10/2006 | Pervan | |
| 7,356,971 | B2 | 4/2008 | Pervan | |
| 8,136,321 | B1 * | 3/2012 | Bauman | E04B 9/0464 52/462 |
| 2002/0112424 | A1 * | 8/2002 | Zaborowski | E04B 9/006 52/220.6 |
| 2004/0060256 | A1 | 4/2004 | Frascari | |
| 2005/0257471 | A1 * | 11/2005 | Stevens | E04B 5/02 52/443 |
| 2009/0151134 | A1 | 6/2009 | Neuhofer | |

FOREIGN PATENT DOCUMENTS

| | | |
|---|---|---|
| DE | 1684060 | 5/1971 |
| DE | 9015211 | 11/1991 |
| WO | 9419561 | 9/1994 |
| WO | 02053859 | 7/2002 |

OTHER PUBLICATIONS

International Search Report, dated Apr. 20, 2010, for corresponding PCT International Application No. PCT/US2010/00634, filed Mar. 1, 2010. WO.

Chinese Search Report, dated Mar. 2, 2016, for corresponding CN Application No. 201410645713.3. CN.

* cited by examiner

LINEAR SURFACE COVERING SYSTEM

CROSS REFERENCE TO RELATED APPLICATION

The present application is a continuation of U.S. application Ser. No. 12/660,583, filed Mar. 1, 2010, which claims the benefit of U.S. provisional application Ser. No. 61/156,036, filed Feb. 27, 2009.

BACKGROUND OF THE INVENTION

The invention relates to a surface covering system, and, more specifically, to an improved linear surface covering system.

Conventional linear surface covering systems are sold by Armstrong World Industries, Inc. under the name WOODWORKS® Linear ceilings and Rulon Company under the name Linear Wood. These systems generally include a plurality of linear planks which are designed to install on linear carriers having factory attached clips. These conventional systems assure alignment and consistent spacing of planks.

The planks of these systems include a pair of grooves, or kerfs routed through the back surface of the plank. These grooves extend into the interior of the plank in a direction generally perpendicular to the back surface. The aforementioned factory-attached clips each have projections that insert into these grooves. In order for a plank to be seated fully on a linear carrier, the plank must be pushed onto the clip thereby allowing the clip projections to enter the grooves. Unfortunately, the existing groove and clip projection interface requires tool adjustment. For example, use of a clamping tool or mallet is likely necessary to ensure that the clip projections achieve a deep seat within the plank grooves and, thus, remain fixedly attached. Additionally, for proper installation, it may be required to draw tight any planks not fitting tightly on the carrier using a screw-type fastener, such as a self-tapping screw. This tightening is typically done after the planks have been seated into place by the necessary tool adjustment.

Additionally, since the linear planks themselves are typically made of natural building materials, they react to changes in humidity and natural stresses and, thus, have a tendency to warp, twist laterally or bow. As a result, without proper support, the seams at the plank ends, i.e. at the butt joint location, may be uneven or slightly twisted. Conventional wisdom for preventing uneven surfaces at these butt joint locations include increasing the thickness of the planks and/or adding reinforcement at the butt joint. What is needed is an improved system which facilitates quicker and simplified assembly in the field and improves stability at the plank seams.

SUMMARY OF THE INVENTION

The invention is an improved surface covering system having a plurality of planks which are installed on linear carriers having factory-applied clips attached thereto. The planks have first and second grooves routed through the back surface thereof. The factory-attached clips have projections that insert into these grooves. The improvement includes each plank having multi-directionally cut grooves. Preferably, at least a portion of these multi-directionally cut grooves are sloped in the direction toward one another. The improvement further includes clip projections which conform substantially to a notch formed by the multi-directional grooves.

The system also includes an improved splice plate for stabilizing two adjacent planks positioned in end-to-end relation. The splice plate has projections which are inserted into the multi-directional grooves of two abutting planks such that the splice is positioned across the butt joint. The splice plate also serves to align the planks laterally. The improvement includes the splice plate projections conforming substantially to a notch formed by the multi-directional grooves. The splice plate also includes a pair of reinforcement wings to counteract stresses which would otherwise result in misalignment at the butt joint location.

The aforementioned improvements also eliminate the need for tool adjustment to ensure the projections of both the clip and splice plate achieve a deep enough seat in the grooves in the back side of the plank. Mere hand pressure is enough to tightly seat the projections of both the clip and splice plate into the plank grooves.

BRIEF DESCRIPTION OF THE DRAWINGS

The same reference numbers will be used throughout the drawings to refer to the same or like parts.

DETAILED DESCRIPTION OF THE DRAWINGS

Figure 1:
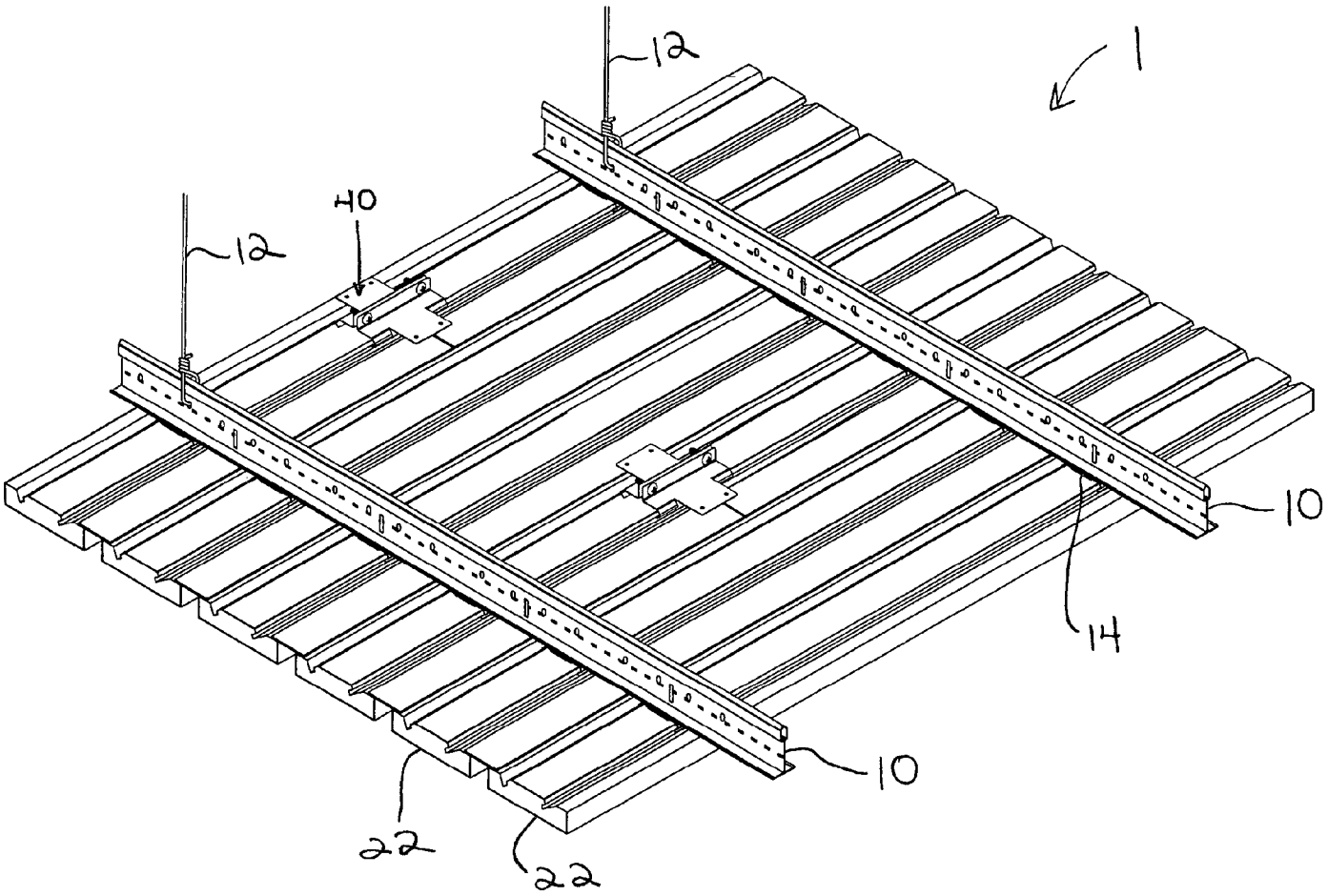
FIG. 1 is a topside perspective view a portion of an exemplary surface covering system of the invention.
Figure 2:
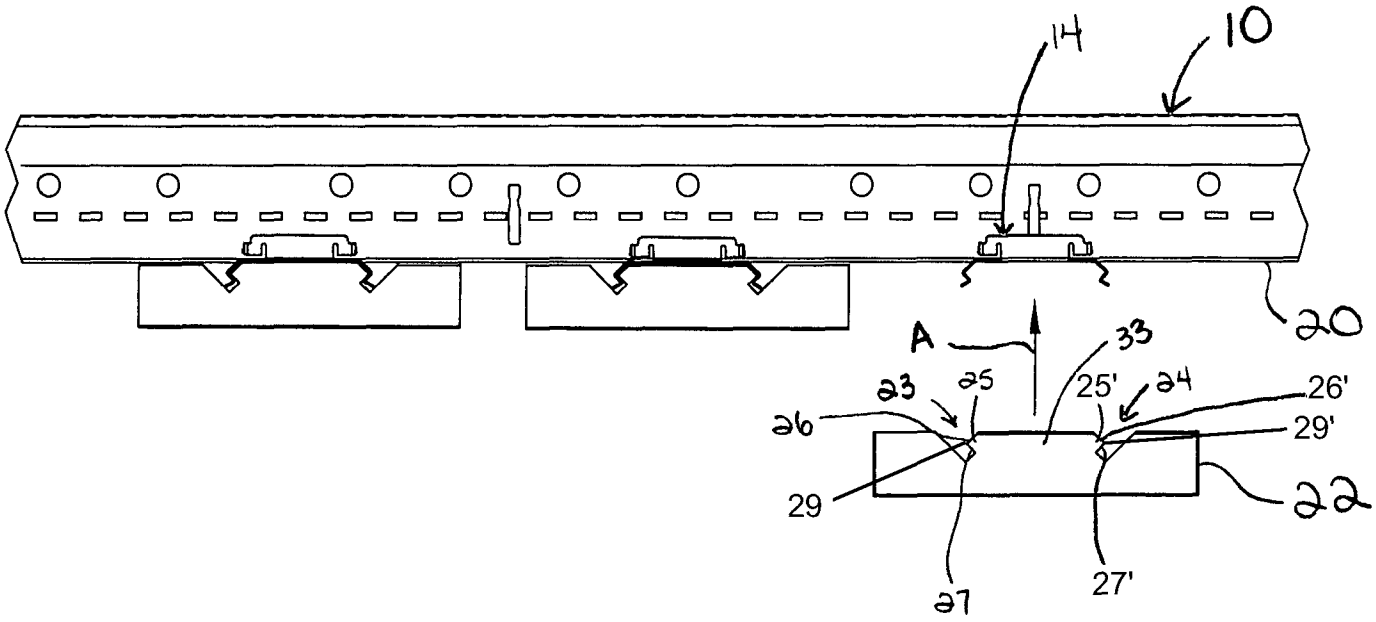
FIG. 2 is a side elevation view, partially exploded, of a portion of an exemplary surface covering system of the invention.
Figure 3:
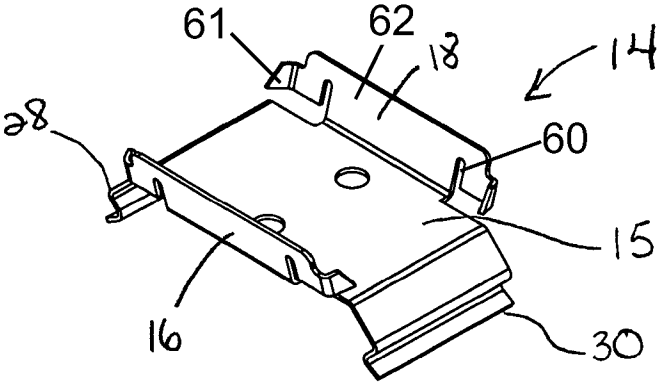
FIG. 3 is a perspective view of an exemplary clip.
Figure 6:
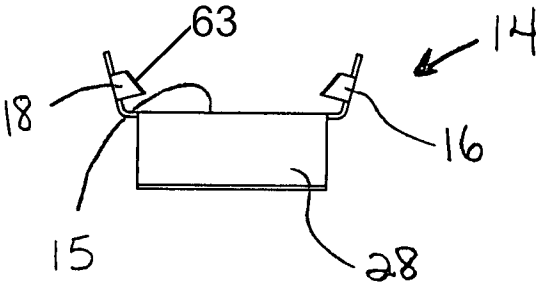
FIG. 6 is a side elevation view of an exemplary clip.
Figure 4:
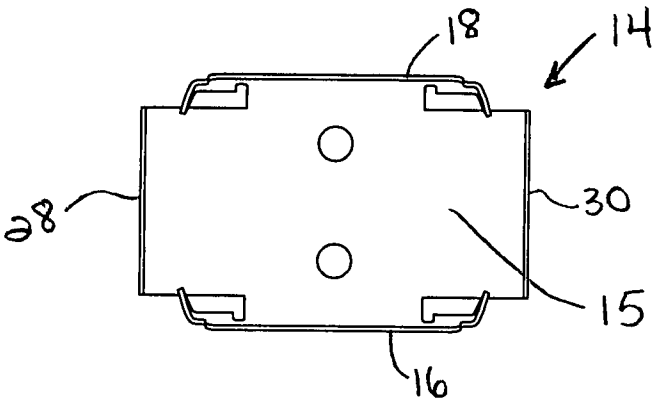
FIG. 4 is a top plan view of an exemplary clip.
Figure 5:
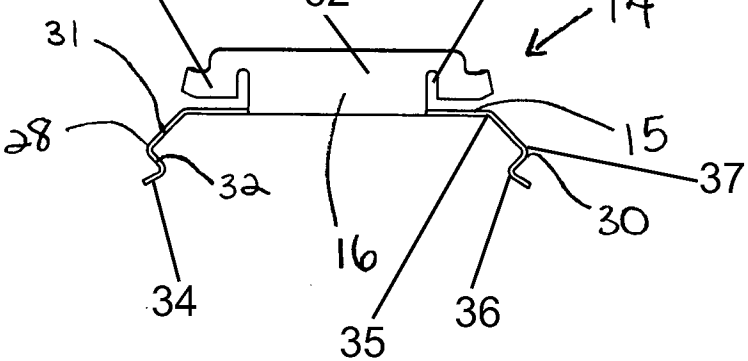
FIG. 5 is a front elevation view of an exemplary clip.

FIGS. 1 and 2 illustrate the improved surface covering system 1. As shown, a plurality of linear carriers 10 are suspended in parallel relation to one another from ceiling hangers 12 such as the hanger wires shown therein. The linear carrier 10 may be a conventional inverted T-shaped grid element as shown. A plurality of clips 14 are attached to the carriers. As best shown in FIGS. 3-6, the clips have a substantially flat main body portion 15 having first and second opposed resilient carrier attachment legs 16, 18 which can be snapped up over the base 20 (FIG. 2) of the linear carrier 10. The attachment legs 16, 18 comprise a body 62 and two arms 61, with a cutout 60 being located therebetween. The two arms 61 are located on opposite outward sides of the body 62 and include a distal end portion 63 that is bent inward toward the main body portion 15. As the example embodiment shown illustrates, the carrier attachment legs 16, 18 can be snapped over the base 20, i.e. the lower horizontal flange, of a conventional inverted T grid element. Though the clips 14 can be applied in the field, they are preferably factory attached to the linear carrier 10 for quicker and easier field installation.

As best seen in FIG. 2, the clips 14 attach a plurality of planks 22 to the linear carriers 10, and, specifically in a direction perpendicular to the linear carriers. Each plank 22 extends along a centerline and comprises a back surface. Each plank 22 includes first and second multi-directionally grooves, 23 and 24 respectively, routed, i.e. cut, through the back surface of each plank. One improvement in and of itself over existing systems is that at least a portion of these groves are sloping, and, preferably, at least a portion of each groove is sloped inwardly in the direction toward one another. In the example embodiment shown, the grooves are formed by a first cut extending from the back surface of the plank and into the interior of the plank in an outward direction. A second cut extends inwardly, thus, forming a multi-directional groove.

As shown in FIG. 2, the first multi-directional groove 23 forms a first notch 25 in a sidewall of the first groove 23. In the example embodiment shown, a first surface portion 26 of the first notch 25—otherwise referred to as a first sloped surface—is sloped downwardly and outwardly. A second surface portion 27 of the first notch 25—otherwise referred to as a first undercut surface—is sloped downwardly and inwardly. The first surface portion 26 of the first notch 25 (i.e., the first sloped surface) and the second surface portion 27 of the first notch 25 (i.e. the first undercut surface) intersect to form a first apex 29. The second multi-directional groove 24 forms a second notch 25' in a sidewall of the second groove 24. In the example embodiment shown, a first surface portion 26' of the second notch 25'—otherwise referred to as a second sloped surface—is sloped downwardly and outwardly. A second surface portion 27' of the second notch 25'—otherwise referred to as a second undercut surface—is sloped downwardly and inwardly. The first surface portion 26' of the second notch 25' (i.e., the second sloped surface) and the second surface portion 27' of the second notch 25' (i.e. the second undercut surface) intersect to form a second apex 29'.

In the example embodiment shown, the first and second surface portions 26, 27 and 26', 27' form a 90 degree angle. As shown in FIGS. 2-6, each clip 14 has first and second projections, 28 and 30 respectively, for attaching a plank 22 to the linear carrier 10. Each projection 28, 30 embodies the profile formed by the respective notch 25, 25'. More specifically, these projections 28, 30 are each bent in multiple directions. As with the notches 25, 25' of the plank 22, a first portion 31 of a protrusion extends downwardly and outwardly from the main body 15 at a first bend 35 while a second portion 32 extends integrally from the first portion 31 at a second bend 36, the second portion 32 being bent downwardly and inwardly, i.e. in a direction toward the another clip protrusion. A third portion 34 of the protrusion extends integrally from the second portion 32 at a third bend 37, the third portion 34 being bent downwardly and outwardly, i.e. in a direction away from the other clip protrusion. Having the third portion 34 extend downwardly and outwardly allows the protrusions 28, 30 to contact and readily pass by the first sloped surface of the first and second notches 25, 25', thereby causing the protrusions 28, 30 to spread apart, as discussed herein.

In the outward direction, the third bend 37 is located between the first bend 35 and the second bend 36 and the second bend 36 is the farthest-most bend from the main body 15 in the outward direction. Along the downward direction, the second bend 36 is located between the first bend 35 and the third bend 37, wherein the third bend is the farthest-most bend from the main body 15 in the downward direction.

The clips 14 are preferably made of a resilient material, such as resilient spring steel. Unlike existing linear surface covering systems, all that is required is for the projections 28, 30 of the clip 14 to contact a respective notch 25, 25', thereby forcing the resilient projections to spread, thereby distorting the profile of the clip. Mere hand pressure in the direction of Arrow A (FIG. 2) is all that is needed to distort the clip profile and snap the plank onto the carrier. One should here an affirmative "snap" noise to indicate that the plank is in proper position on the linear carrier. For each resilient clip 14, the first protrusion 28 is configured to deform as the first protrusion 28 rides along the first sloped surface (i.e. the first surface portion 26 of the first notch 25) and passes over the first apex 29. The first protrusion 28 is also configured to snap-fit into engagement with the first undercut surface (i.e., the second surface portion 27 of the first notch 25) after the third portion 34 of the first protrusion 28 passes over the first apex 29. For each resilient clip, the second protrusion 30 is configured to deform as the second protrusion 30 rides along the second sloped surface (i.e., the second surface portion 27' of the second notch 25') and passes over the second apex 29', and the second protrusion 30 snap-fitting into engagement with the second undercut surface (i.e., the first surface portion of the second notch 25') after the third portion 34 of the second protrusion passes over the second apex 25'.

Installing the linear surface covering system 1 includes the steps of positioning a plank 22 adjacent to a resilient clip 14 that is mounted to a carrier 10 and applying pressure to the plank in the direction of Arrow A, which is substantially orthogonal to the back surface of the plank 22. With pressure applied in the direction of Arrow A, the first protrusion 28 moves into the first multidirectional groove 23 and the second protrusion moves 30 into the second multi-directional groove 24. During the movement of the first and second protrusions 28, 30 into the first and second multi-directional grooves 23, 24, the first and second protrusions 28, 30 (1) spread outwardly from one another to allow a back portion 33 of the plank 22 to pass between the first and second protrusions 28, 30 during a first stage of said movement, and (2) then snap-back toward one another to engage the back portion 33 of the plank 22 upon a second stage of said movement, the second stage of said movement being subsequent to the first stage of said movement. Once snapped into place, application of pressure to the plank may be discontinued—thereby resulting in the plank being mounted to the carrier by the resilient clip. Thus, the need for tool adjustment to ensure the projections of the clip achieved a deep enough seat in the grooves is eliminated. Moreover, screws are not required to more positively secure the planks to the carriers.

In another embodiment, the linear surface covering system 1 is installed by positioning a plank 22 adjacent to a resilient clip 14 that is mounted to a carrier 10 and applying pressure to the plank in a direction of Arrow A, which is substantially orthogonal to the back surface of the plank. The pressure applied to the plank 22 causes the first protrusion 28 to move into the first multidirectional groove 23 and the second protrusion 30 to move into the second multi-directional groove 24, wherein during said movement of the first and second protrusions 28, 30 into the first and second multi-directional grooves 23, 24, the first and second protrusions 28, 30 (1) first spread outwardly from one another to allow a back portion 33 of the plank 22 to pass between the first and second protrusions 28, 30 during a first stage of said movement, and followed by snap-back toward one another to engage the back portion 33 of the plank 22 upon a second stage of said movement. The second stage of the movement is subsequent to the first stage of said movement. Finally, the application of said pressure to the plank is discontinued—thereby resulting in the plank being mounted to the carrier by the resilient clip 14. According to the present invention, the need for tool adjustment to ensure the projections 28, 30 of the clip 14 achieved a deep enough seat in the grooves 23, 24 is eliminated. Moreover, screws are not required to more positively secure the planks 22 to the carriers 10.

As shown, once the clip projections are fully seated in their respective groove, the profile will return to its undistorted, i.e. non-tensioned, profile. Specifically, the first and second protrusions 28, 30 are biased, causing the resilient clip 14 to return to a substantially non-deformed state after each of the plurality of planks 22 are snap-fit to the resilient clip 14. The first portion 31, the second portion 32, and the third portion 34 of the first protrusion 28 of the resilient clip 14 extend into the first multi-directional groove 23 of the one of the planks 22 and the first portion 31, the second portion 32, and the third portion 34 of the second protrusion 30 of the clip 14 extend into the second multi-directional groove 24 of the one of the planks 22. The notches 25, 25' and the portion 33 of the back of the plank 22 between the two grooves 23, 24 will be encapsulated by the relaxed clip 14 and a portion of the protrusions will be positioned under the notches 25, 25' which will serve to support a plank 22 suspended from the linear carrier 10. The preferred configuration of the clip 14 supporting a plank 22 in a non-tensioned state, adds strength to the attachment of the plank to the carrier. In other words, as one of skill in the art would understand, a plank would be more easily removed from the carrier if the clips supporting the planks were in tension.

Figures 7, 8:
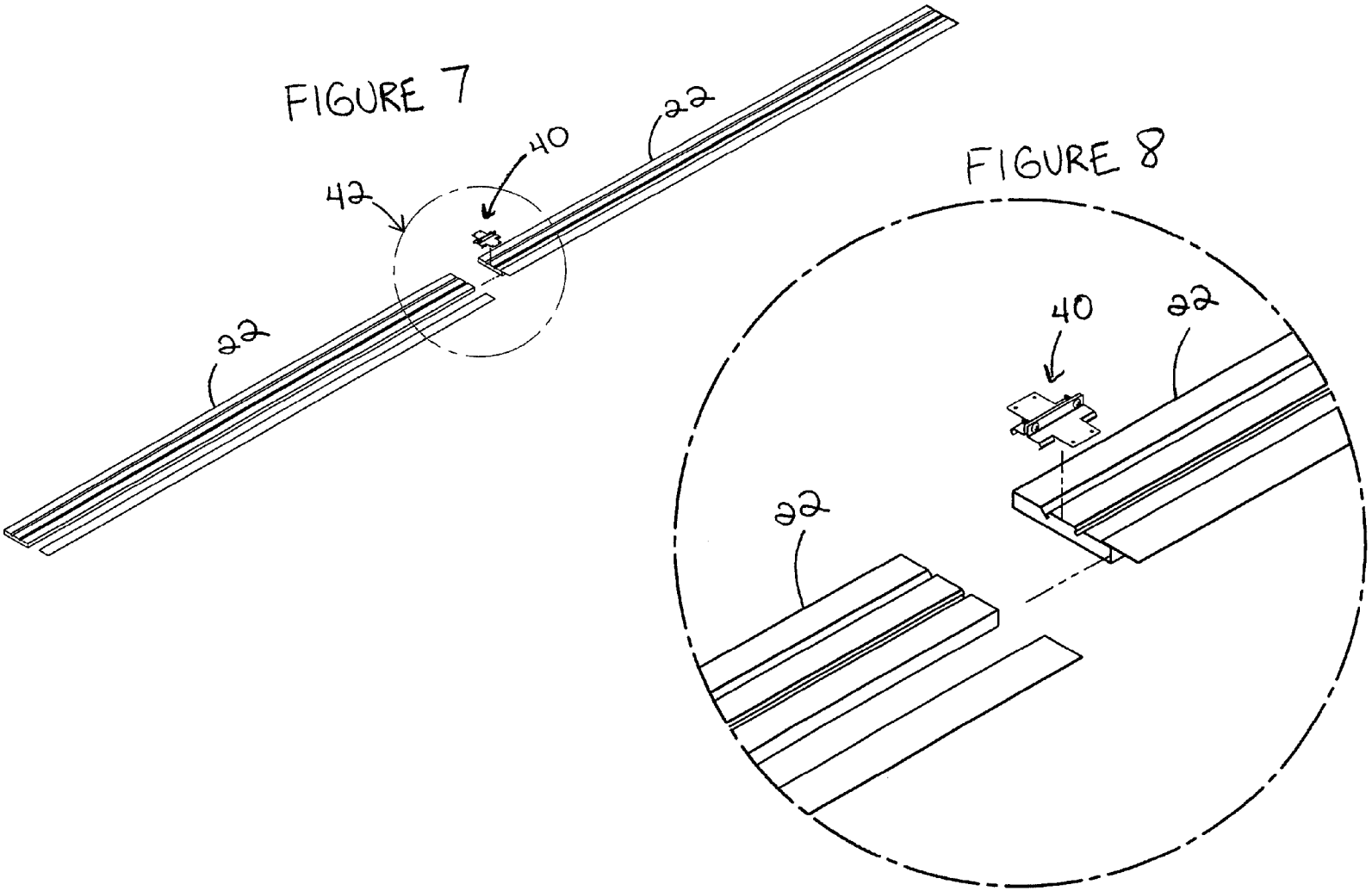
FIG. 7 is an exploded perspective view of two exemplary planks positioned end to end.
FIG. 8 is a detailed view of portion A shown in FIG. 7.
Figure 9:
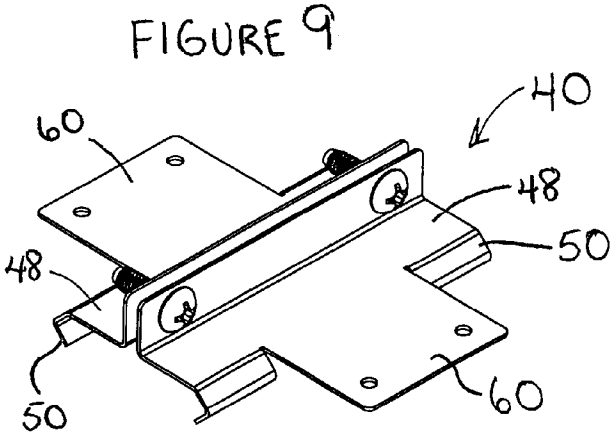
FIG. 9 is a perspective view of an exemplary splice plate.
Figure 12:
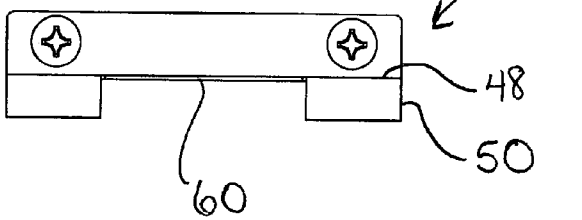
FIG. 12 is a side elevation view of an exemplary splice plate.
Figure 10:
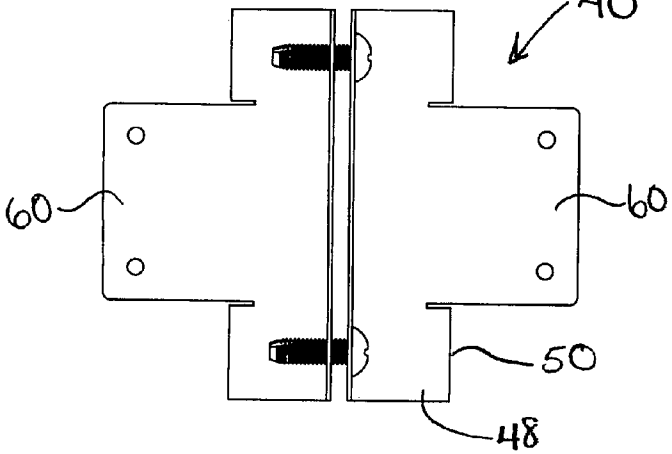
FIG. 10 is a top plan view of an exemplary splice plate.

FIGS. 7 and 8 illustrate the use of a splice plate 40 for spanning a butt joint 42 of two planks 22 positioned end-to-end. As shown in FIGS. 9-12, the splice plate is formed of two halves 44, 46, each half containing a body portion 48 and an attachment projection 50. As with protrusions 28, 30 of clip 14, each splice plate plank attachment projection 50 embodies the profile formed by notch 25. Thus, the splice plate projections 50 are bent in multiple directions as described above in reference to protrusions 28 and 30.

Figure 11:
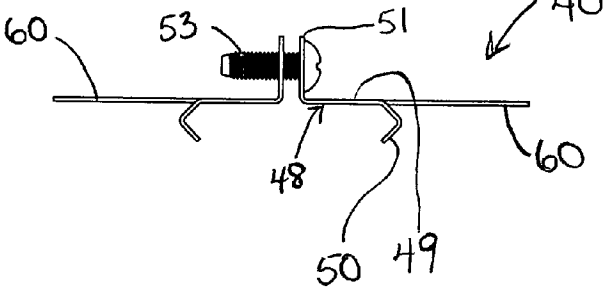
FIG. 11 is a front elevation view of an exemplary splice plate.

Further, as best shown in FIG. 11, the body portion 48 of each half includes a first portion 49 extending in a first direction and a second portion 51 extending integrally from the first portion in a direction generally perpendicular thereto. The second portions 51 of each body half include the means for attaching the body portions of each half to one another. For example, the second portions 51 of each body half may include threaded apertures for inserting one or more screw-type fasteners 53. Once the attachment projections of each half are at least partially seated in the plank grooves, the screw-type fastener can thus be used to bring the halves closer together.

The splice plate of the invention provides the capability of applying more holding force around the grooves, than, for example by, snapping the splice on the abutting planks as described below. Such capability is desirable since it holds the ends of the planks tighter at the seam which, in turn, improves the visual at the seam. In addition, the added strength of the hold helps impede twisting of the plank to prevent unevenness of the planks at the butt joint, again, improving the visual. In effect, the splice plate creates a longer length of wood, i.e. create a plank unit, and most importantly, control the location of the impact of the stresses. More specifically, several planks can act and move as one, in turn, distributing the forces acting thereon to the edges of the plank unit. An additional advantage of the splice plate is that more complex edge detail of the planks (e.g. tongue and groove configuration) is not needed to impart the necessary strength at the plank seems. Thus, the edge detail can be simplified to a flat/flush edge detail.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

For example, the grooves 23, 24 can form the notch 25 on the opposite wall, i.e. outboard wall, of a groove by inverting the direction of the cuts forming the grooves. In other words, the first surface portion 26 of the notch 25 would be sloped downwardly and inwardly and the second surface portion 27 would be sloped downwardly and outwardly. In turn, the projections 28 and 30 of the clip 14 would be bent to correspond to the contours of the notch 25. Instead of springing the protrusions outwardly, the notches would press the protrusions inwardly. As the protrusions move deeper in their respective groove, the protrusions would spring outwardly, thus seating a portion of the protrusion below the notch.

Optionally, as best seen in FIGS. 9-12, each half of the splice plate 40 may include a reinforcement wing 60 which extends outwardly from an edge of the first portion 49 of the body distal the edge from which the second portion 51 of the body 48 extends. The wings 60 span over top of the butt joint to further counteract the stresses of the plank material.

Also, the splice plate could be formed of a single piece of resilient material similar to the clips described above. Thus, in the one-piece configuration, the splice plate would be snapped over the pair of notches in a similar fashion thereto.

The invention claimed is:

1. A method of installing a linear surface covering system comprising:

a) positioning a plank adjacent to a resilient clip mounted to a carrier, the resilient clip comprising a main body portion having a center plane and first and second protrusions located on opposite sides of the main body portion, the plank comprising a back surface and first and second multi-directional grooves extending from the back surface into the interior of the plank;

b) applying pressure to the plank thereby causing the plank to translate toward the carrier in a direction substantially orthogonal to the back surface of the plank and causing the first protrusion to move into the first multidirectional groove and the second protrusion to move into the second multi-directional groove, wherein during said movement of the first and second protrusions into the first and second multi-directional grooves, each of the first and second protrusions: (1) spread outwardly from the central plane of the resilient clip to allow a back portion of the plank to pass between the first and second protrusions during a first stage of said movement; and (2) snap-back toward one another to engage the back portion of the plank upon a second stage of said movement, the second stage of said movement being subsequent to the first stage of said movement; and c) discontinuing said application of said pressure from the plank, the plank being mounted to the carrier by the resilient clip.

2. The method of installing a linear surface covering system of claim 1, further comprising d) coupling the plank to an adjacent plank by a splice plate, the splice plate spanning a butt joint of the plank and the adjacent plank positioned end-to-end.

3. The method of installing a linear surface covering system of claim 1, wherein the first multidirectional groove and the second multi-directional groove are each inboard grooves.

4. The method of installing a linear surface covering system of claim 1, wherein during step b) the first protrusion contacts at least a portion of a first side-wall of the first multidirectional groove causing the first protrusion to spread outwardly from the central plane of the resilient clip.

5. The method of installing a linear surface covering system of claim 1, wherein during step b) the second protrusion contacts at least a portion of a second side-wall of the second multidirectional groove causing the second protrusion to spread outwardly from the central plane of the resilient clip.

6. A method of installing a linear surface covering system comprising:

a) positioning a plank adjacent to a resilient clip comprising a main body portion and first and second protrusions located on opposite sides of the main body portion, the plank comprising a back surface, a first multi-directional inboard groove having a first floor, and a second multi-directional inboard groove having a second floor, the first and second multi-directional grooves extending from the back surface into the interior of the plank, the back surface having a central portion positioned between first and second edge portions, wherein a first side surface of the first multi-directional inboard groove extends upward from the first floor to the first edge portion and a first side surface of the second multidirectional inboard groove extends upward from the first floor to the second edge portion;

b) applying pressure to the plank thereby causing the first protrusion to move into the first multidirectional inboard groove and the second protrusion to move into the second multi-directional inboard groove, wherein during said movement of the first and second protrusions into the first and second multi-directional inboard grooves, the first and second protrusions: (1) spread outwardly from one another to allow a back portion of the plank to pass between the first and second protrusions during a first stage of said movement; and (2) snap-back toward one another to engage the back portion of the plank upon a second stage of said movement, the second stage of said movement being subsequent to the first stage of said movement; and c) discontinuing said application of said pressure from the plank, the plank being mounted to the resilient clip.

7. The method of installing a linear surface covering system of claim 6, further comprising d) coupling the plank to an adjacent plank by a splice plate, the splice plate spanning a butt joint of the plank and the adjacent plank positioned end-to-end.

8. The method of installing a linear surface covering system of claim 6, wherein during step b) the first protrusion contacts at least a portion of a first side-wall of the first multidirectional groove and the second protrusion contacts at least a portion of a second side-wall of the second multidirectional groove causing the first and second protrusions to spread outwardly from each other.

9. The method of installing a linear surface covering system of claim 6, wherein the first and second edge portions of the back surface are substantially co-planar.

10. The method of installing a linear surface covering system of claim 6, wherein a second side surface of the first multi-directional inboard groove extends upward from the first floor to the central portion.

11. The method of installing a linear surface covering system of claim 10, wherein the first side surface of the first multi-directional inboard groove opposes the second side surface of the first multi-directional inboard groove.

12. The method of installing a linear surface covering system of claim 6, wherein a second side surface of the second multi-directional inboard groove extends upward from the second floor to the central portion.

13. The method of installing a linear surface covering system of claim 12, wherein the first side surface of the second multi-directional inboard groove opposes the second side surface of the second multi-directional inboard groove.

14. A method of installing a ceiling system comprising:

a) positioning a plank adjacent to a resilient clip mounted to a carrier, the resilient clip comprising a main body portion and first and second protrusions located on opposite sides of the main body portion, the first protrusion having a first cross-section and the second protrusion having a second cross-section, whereby the first cross-section is a mirrored image of the second cross-section, the plank comprising a back surface and first and second multi-directional grooves extending from the back surface into the interior of the plank;

b) applying upward pressure to the plank thereby causing the first protrusion to move into the first multidirectional groove and the second protrusion to move into the second multi-directional groove, wherein during said movement of the first and second protrusions into the first and second multi-directional grooves, each of the first and second protrusions: (1) spread outwardly from one another to allow a back portion of the plank to pass between the first and second protrusions during a first stage of said movement; and (2) snap-back toward one another to engage the back portion of the plank upon a second stage of said movement, the second stage of said movement being subsequent to the first stage of said movement; and c) discontinuing said application of said pressure from the plank, the plank being mounted to the carrier by the resilient clip.

15. The method of installing a ceiling system of claim 14 further comprising suspending the carriers from a ceiling prior to step a).

16. The method of installing a ceiling system of claim 14, wherein the plank comprises a front surface opposite the back surface, wherein the front surface of the plank faces downward once mounted to the carrier by the resilient clip.

17. The method of installing a linear surface covering system of claim 14, wherein applying the pressure to the plank causes the plank to translate upward toward the carrier.

18. The method of installing a linear surface covering system of claim 14, further comprising d) coupling the plank to an adjacent plank by a splice plate, the splice plate spanning a butt joint of the plank and the adjacent plank positioned end-to-end.

19. The method of installing a linear surface covering system of claim 14, the resilient clip comprises a center plane and during step b), each of the first and second protrusions spread outwardly from the central plane of the resilient clip.

20. The method of installing a linear surface covering system of claim 14, wherein during step b) the first protrusion contacts at least a portion of a first side-wall of the first multidirectional groove and the second protrusion contacts at least a portion of a second side-wall of the second multidirectional groove causing the first and second protrusions to spread outwardly from each other.

* * * * *